US011332924B2

(12) United States Patent
Marshall et al.

(10) Patent No.: US 11,332,924 B2
(45) Date of Patent: May 17, 2022

(54) END BRACKETS

(71) Applicant: Falkbuilt Ltd., Calgary (CA)

(72) Inventors: Dale R. Marshall, Foothills (CA); Jesse Van Mastrigt, Calgary (CA); Clayton Smed, Calgary (CA); Young-sun Ryu, Calgary (CA)

(73) Assignee: Falkbuilt Ltd., Calgary (CA)

( * ) Notice: Subject to any disclaimer, the term of this patent is extended or adjusted under 35 U.S.C. 154(b) by 0 days.

(21) Appl. No.: 17/063,207

(22) Filed: Oct. 5, 2020

(65) Prior Publication Data

US 2021/0180315 A1 Jun. 17, 2021

Related U.S. Application Data

(60) Provisional application No. 62/948,524, filed on Dec. 16, 2019.

(51) Int. Cl.

| | |
|---|---|
| ***E04B 2/00*** | (2006.01) |
| ***E04B 1/41*** | (2006.01) |
| ***E04B 1/58*** | (2006.01) |
| ***E04B 2/56*** | (2006.01) |
| *E04B 1/38* | (2006.01) |

(52) U.S. Cl.

CPC ..... *E04B 1/40* (2013.01); *E04B 1/5818* (2013.01); *E04B 2/56* (2013.01); *E04B 2001/405* (2013.01)

(58) Field of Classification Search

None

See application file for complete search history.

(56) References Cited

U.S. PATENT DOCUMENTS

| | | | | |
|---|---|---|---|---|
| 5,685,662 | A * | 11/1997 | Rollin | B62D 33/044 403/231 |
| 5,839,240 | A * | 11/1998 | Elsholz | E04B 2/7433 52/242 |
| 6,109,461 | A * | 8/2000 | Kluge | A47B 57/30 211/103 |
| 6,213,679 | B1 * | 4/2001 | Frobosilo | E04B 2/82 403/403 |
| 6,481,177 | B1 * | 11/2002 | Wood | F16B 7/187 52/656.9 |
| 9,963,869 | B1 * | 5/2018 | Mironchuk | A47K 3/36 |
| 2002/0062617 | A1 * | 5/2002 | diGirolamo | E04B 2/767 52/688 |
| 2010/0006518 | A1 * | 1/2010 | Brobst | F16B 7/187 211/26 |

(Continued)

FOREIGN PATENT DOCUMENTS

| | | |
|---|---|---|
| WO | 2017069698 | 4/2017 |

OTHER PUBLICATIONS

Slotted Standard Hooks Image; Retrieved from internet search Jun. 2019; 1 page.

(Continued)

*Primary Examiner* — Basil S Katcheves

(74) *Attorney, Agent, or Firm* — Amy Fiene; Tyler Jeffs; Fabian VanCott

(57) ABSTRACT

An end bracket for a wall system includes a body member having attachment structure to join a horizontal strut to a vertical strut. The end bracket further includes attachment structure in which the horizontal strut is slidably attached for moving and positioning the horizontal strut relative to the vertical strut in forming the wall system.

11 Claims, 12 Drawing Sheets

(56) References Cited

U.S. PATENT DOCUMENTS

| | | | | |
|---|---|---|---|---|
| 2013/0091691 | A1* | 4/2013 | Oetlinger | F16B 12/50 29/525.02 |
| 2014/0331564 | A1* | 11/2014 | Wei | E06B 3/964 49/505 |
| 2016/0069072 | A1* | 3/2016 | Rice | E04B 2/763 52/696 |
| 2017/0204600 | A1* | 7/2017 | Daudet | E04B 1/2403 |
| 2018/0094422 | A1* | 4/2018 | Getz | E04B 1/2403 |
| 2019/0249418 | A1* | 8/2019 | Chapman | E04B 1/40 |
| 2019/0380492 | A1* | 12/2019 | Heap | A47B 57/406 |

OTHER PUBLICATIONS

Racking Images; Retrieved from internet search Apr. 2019; 1 page.

* cited by examiner

END BRACKETS

BACKGROUND

Digitized wall systems provide innovative solutions over drywall installation by providing manufactured wall components to be used for quick and efficient onsite installation.

DETAILED DESCRIPTION

Figure 1:
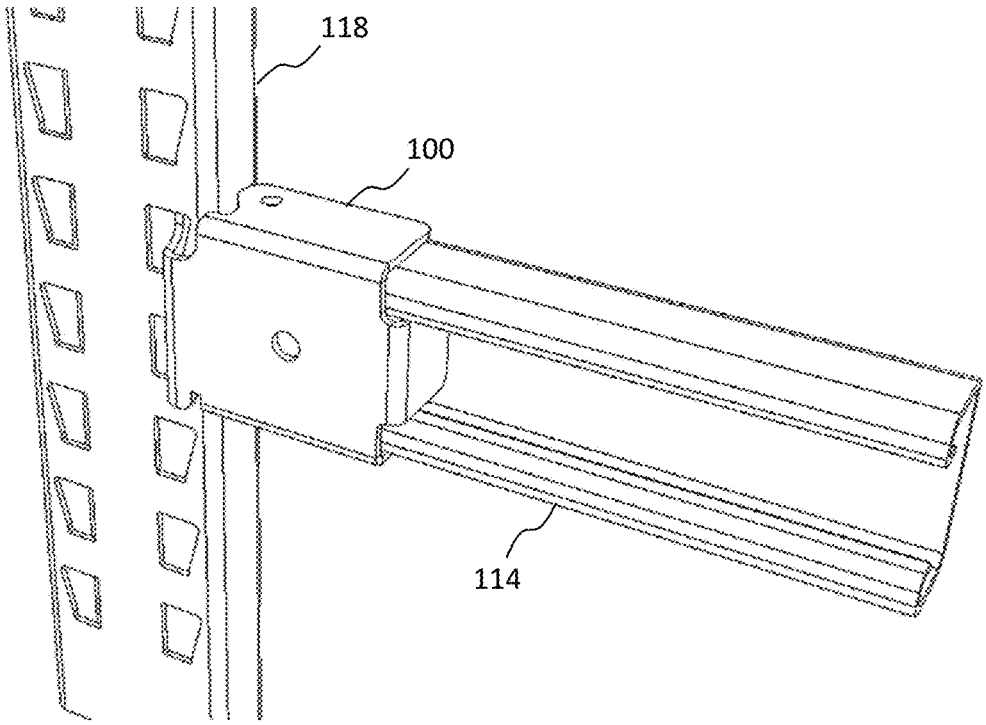
FIG. 1 illustrates a perspective view of horizontal and vertical strut with an end bracket according to an example of the principles described herein.

In general, construction projects may involve the purchase and delivery to a job site of 30% more materials than what is needed. These projects rely on materials/tools such as screw guns, time, garbage bins, and a laborer to fill the garbage bins with waste created from the construction. When the project is completed, the bin is hauled to a dump.

In another example referred to as modular construction, everything needed is built in a factory, loaded in trucks, and then taken to a jobsite. After the walls or room modules are unloaded, the modules are placed side-by-side in precisely designated locations and orientations. Each module is then individually leveled and attached to adjacent modules.

The present specification describes a construction method that combines aesthetics with high-performing and cost-effective environments. Work spaces, classroom settings, and hospital rooms are just a few examples of environments in which these construction methods may be used.

The present specification describes digital component construction. Using digital technology, individual components are precisely manufactured and then delivered and installed in the same manner and by the same trades as conventional construction. There is no need, however, for clean up or waste removal. The cost remains competitive with conventional and modular constructions.

As part of a digital component construction, various horizontal and vertical struts are dimensioned based on a digital layout and then manufactured according to those dimensions. They are then used to provide a framework in which panels, shelving, cabinets, and other structures can be attached. To ensure a proper fit between strut members, end brackets are used that allow for the struts to be shortened or lengthened anywhere from millimeters, centimeters, to inches, and feet, depending on the size of the end bracket.

In an example, an end bracket for a wall system includes a body member having a first attachment structure to join a horizontal strut to a vertical strut. The end bracket further includes a second attachment structure in which the horizontal strut is slidably attached for moving and positioning the horizontal strut relative to the vertical strut in forming the wall system. At least a portion of the end bracket is available to lengthen the horizontal strut depending on the position of the horizontal strut.

In another example, an end bracket for a wall system includes a body member that has a substantially planar body member. The end bracket further includes an attachment structure having a pair of lateral, planar plates extending orthogonally from opposed vertical ends of the body member. A planar insert member extends orthogonally from a side of the body member. The planar insert member has an arm-like configuration so as to be inserted within a slot of the vertical strut to removably engage the body member to the vertical strut and prevent dislodgment of the body member from the vertical strut. At least a first set hole is located on at least one of the planar plates and spaced a width apart from the insert member. At least a second set hole is centrally located on the body member. The end bracket is to be attached to at least one slot of a vertical struct by inserting the insert member within the slot. A horizontal strut is to be slidably inserted between the planar plates and secured to the end bracket at a desired horizontal position relative to the end bracket. Screws may be screwed into the first and second set holes to secure the horizontal strut to the end bracket at the desired horizontal position.

In another example, an end bracket for a wall system includes a body member with a substantially planar body member. The end bracket further includes attachment structure with a pair of spaced and substantially parallel, planar, vertical plates extending orthogonally from opposed vertical ends of the body member. Each plate is symmetrical to each other around a central horizontal axis of the end bracket. Each plate also includes a notch at or near an intersection of the body member and respective planar plate.

The end bracket further includes a planar insert member extending orthogonally from a lateral end of the body member. The insert member is to be inserted within a slot of a vertical strut to removably engage the end bracket to the vertical strut and prevent dislodgement of the end bracket from the vertical strut. A horizontal strut is to be slidably mounted between the planar plates of the attachment structure and moved to a desired position. Each notch provides a visibility gap between an outer side of the vertical strut and an outer side of each planar plate in which a position of a free end of the horizontal strut may be viewed. The end bracket includes a locking structure to secure the horizontal strut at a desired position relative to the end bracket.

Turning to FIG. 1, an end bracket 100 is shown that attaches a horizontal strut 114 to a vertical strut 118, according to an example of principles described herein. The end bracket 100 includes a rectangular, cube-like joint that connects the two long members of the struts 114 and 118 together. While small in comparison to the struts 114 and 118, the end bracket 100 includes attachment structure that not only provides a strong and secure connection between the struts 114 and 118, but also enables significant structural changes that can make a wall system stronger and more stable.

Particularly, the end bracket 110 attaches at or near a free end of the horizontal strut 114 to attach the horizontal strut 114 at a location along a longitudinal length of the vertical strut 118. The end bracket 110 may attach at various locations along the vertical strut 118 depending on the type of connections available along the longitudinal length of the vertical strut 118. The end bracket 100 is shown attached at or near an edge of a back side of the vertical strut 118, however the attachment may occur on a side of the vertical strut 118 or other location where possible.

The horizontal strut 114 slides within a cavity of the end bracket 100 in a longitudinal, horizontal direction and is thereby relatively lengthened or shortened to provide a variable length in which to support the vertical strut 118.

Figure 2:
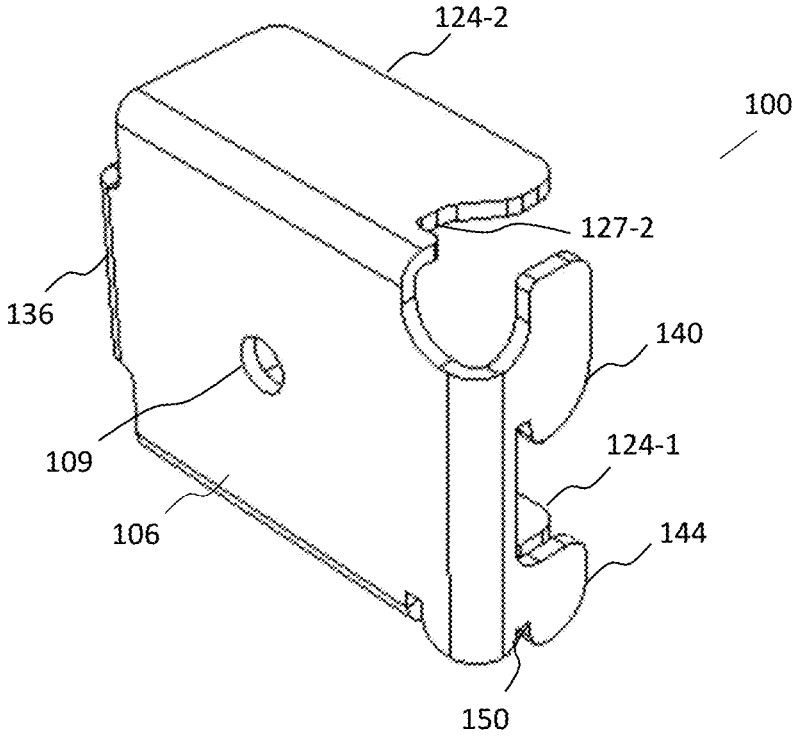
FIG. 2 illustrates a perspective view of an end bracket according to an example of the principles described herein.
Figure 3:
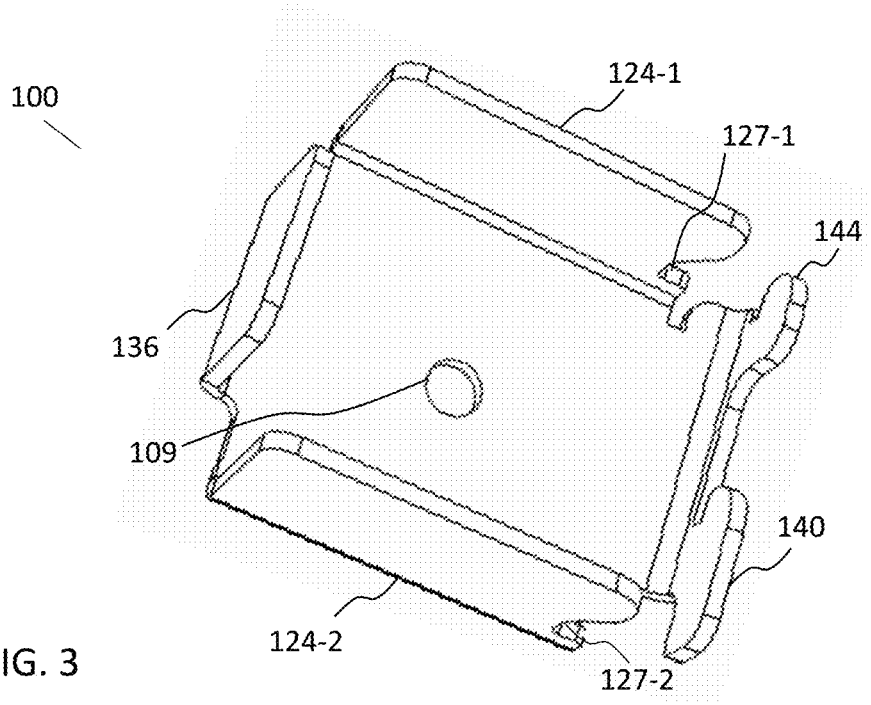
FIG. 3 illustrates a perspective view of an end bracket according to an example of the principles described herein.
Figure 4:
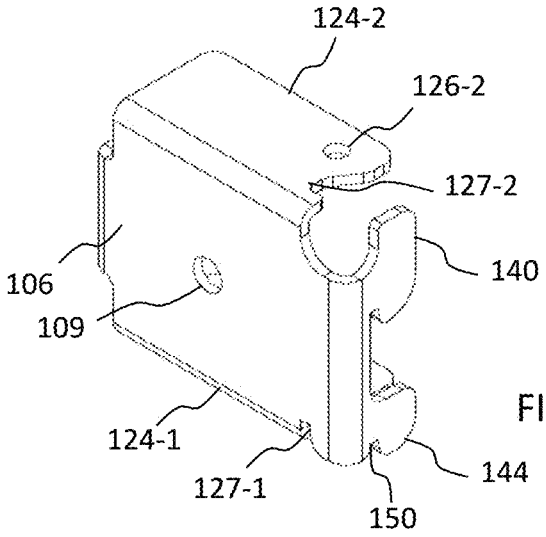
FIG. 4 illustrates a perspective view of an end bracket according to an example of the principles described herein.
Figure 6:
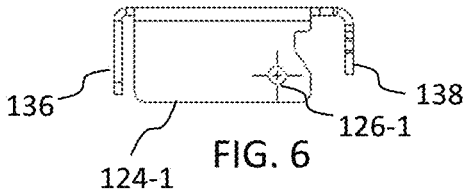
FIG. 6 illustrates a side view of an end bracket according to an example of the principles described herein.
Figure 7:
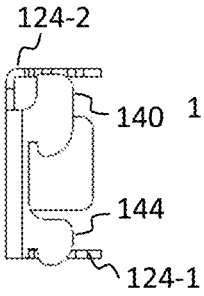
FIG. 7 illustrates a side view of an end bracket according to an example of the principles described herein.
Figure 5:
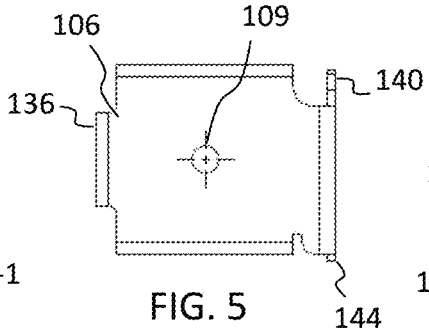
FIG. 5 illustrates a bottom view of an end bracket according to an example of the principles described herein.
Figure 8:
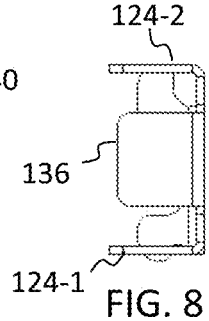
FIG. 8 illustrates a side view of an end bracket according to an example of the principles described herein.
Figure 9:
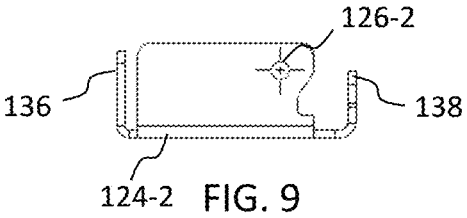
FIG. 9 illustrates a side view of an end bracket according to an example of the principles described herein.
Figure 10:
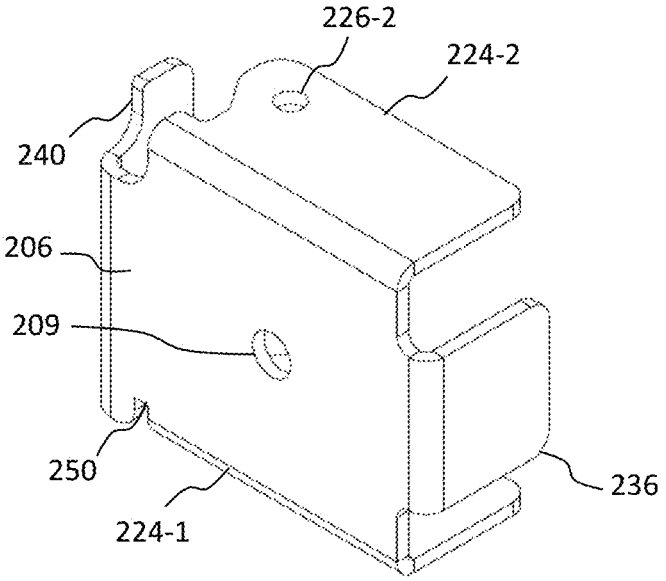
FIG. 10 illustrates a perspective view of an end bracket according to an example of the principles described herein.
Figure 12:
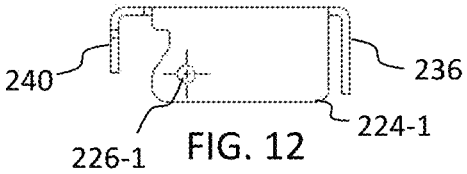
FIG. 12 illustrates a side view of an end bracket according to an example of the principles described herein.
Figure 13:
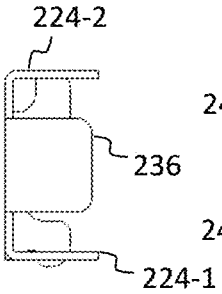
FIG. 13 illustrates a side view of an end bracket according to an example of the principles described herein.
Figure 11:
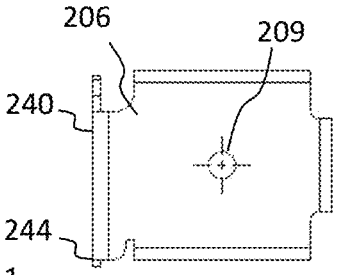
FIG. 11 illustrates a bottom view of an end bracket according to an example of the principles described herein.
Figure 14:
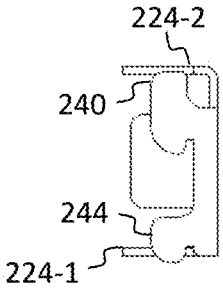
FIG. 14 illustrates a side view of an end bracket according to an example of the principles described herein.
Figure 15:
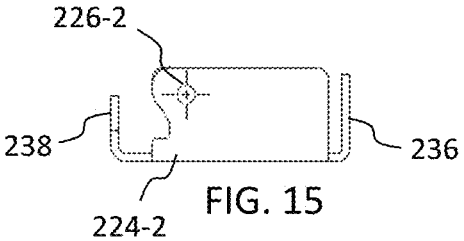
FIG. 15 illustrates a side view of an end bracket according to an example of the principles described herein.

Turning to FIGS. 2 and 3, various views of an end bracket 100 are shown. The end bracket 100 includes a body member 106 which is a substantially planar body member. Attached to free ends of the body member 106 is the attachment structure.

The term "attachment structure" is used collectively herein to refer to one or more various structures that are used to attach the end bracket 100 to the horizontal 114 and vertical struts 118. As used herein, a first attachment structure refers to attachment structure that joins a horizontal strut to a vertical strut, namely, a first insert member 140 or a second insert member 144. A second attachment structure refers to an attachment structure in which the horizontal strut is slidably attached for moving and positioning the horizontal strut relative to the body member, namely, planar plate 124-1, planar plate 124-2, and or extension member 136, as shown.

The attachment structure enables the horizontal strut 114 to be slidably mounted so as to move horizontally relative to the end bracket 100 and thus have a variable apparent length. For example, the horizontal strut 114 can be lengthened or shortened between two vertical struts 118 to accommodate slight differences in a theoretical layout compared to an actual layout. Differences between layouts may be caused by inaccurate measurements, imperfect ground surfaces, imperfect materials, effects on materials from temperature and humidity, changes made between layouts, as well as other causes. Also, laymen may desire various tightness of fit of the horizontal strut 114 with the vertical strut 118 and may want to lengthen or shorten the horizontal strut 114 to achieve that purpose. The end bracket 100 further enables a variable length to provide a desired precision of fit or tightness between a horizontal and vertical strut.

The end bracket 100 may further include a locking structure, such as a central hole 109 which is a set hole centrally located on the body member 106 that enables a screw disposed therethrough to ensure that the fit or tightness between the horizontal strut 114 and the end bracket 100 remains secure.

At least one insert member may be used for attaching the end bracket 100 to the vertical strut 118. As shown, an insert member includes a first insert member 140 and a second insert member 144 that extend orthogonally from a side of the body member 106. The first insert member 140 includes a flat arm-like or hook-like planar member that extends vertically upward to be removably inserted within a first slot of the vertical strut 118. From the same side of the body member 106, opposing second insert member 144 includes a flat arm-like or hook-like planar member that extends vertically downward to be removably inserted within a second slot of the vertical strut 118. The arm of the first insert member 140 extends farther upward than the second insert member 144 to prevent upward movement and rotational movement that would release the end bracket 100 from the vertical strut 118. The second insert member 144 includes a divet 150 on a bottom facing side with sides of the divet 150 extending vertically downward to engage around the same or different slot as the first insert member 140 and thereby provide a rest or horizontal support for the end bracket 100, prevent dislodgement and retain the end bracket 100 vertically to the vertical strut 118.

The extension member 136 includes a planar arm member extending orthogonally from a lateral side of the body member 106 and opposite to the first 140 and second insert members 144. The extension member 136 is to be received between sides of the horizontal strut 114 to support the horizontal strut 114 and prevent rotation of the horizontal strut 114 relative to the end bracket 100. As shown, the extension member 136 is centrally located along a side of the body member 106 and has a vertical length that is less than the vertical length of the body member 106 so as to fit within rails of a horizontal strut 114.

A pair of planar plates 124-1, -2 extend orthogonally from opposed vertical ends of the body member 106. Each plate 124-1, -2 is symmetrical to each other around a central horizontal axis of the end bracket 100. Each plate 124-1, -2 includes a notch 127-1, -2 on a side of the plate adjacent to first 130 and second insert members 144. The notch 127-1, -2 is a rounded cutout that juts inward toward the inner portion of the respective plate 124-1, -2. The outer edge of each plate 124-1, -2 appears to have an undulating or contoured edge that provides a gap for visibility of the underlying horizontal strut 114 as it passes through the end bracket 100. The cutout out may have sharp corners instead.

The horizontal strut 114 is to be slidably mounted between the planar plates 124-1, -2. The horizontal strut 114 is to be horizontally moved between the plates 124-1, -2 to a desired position relative to the plates 124-1, -2.

The end bracket 100 further includes a locking structure to attach the end bracket 100 to the horizontal strut 114 once the horizontal strut 114 is in the desired position. As shown, a central hole 109, a set hole or other type of hole, is located on the body member 106. The central hole 109 extends therethrough and is centrally located on the body member 106. The locking structure may include a screw that is screwed through the central hole 109 to attach the end bracket 100 to the horizontal strut 114.

Turning to FIGS. 4-9, various views of the end bracket 100 are shown. The end bracket 100 in FIGS. 4-9 is a left end bracket with respect to a back view perspective. The end bracket 100 is used to secure a left end of a horizontal strut 114 to a vertical strut 118 with the body member 106 shown on the outside of the horizontal strut 114.

Figure 20:
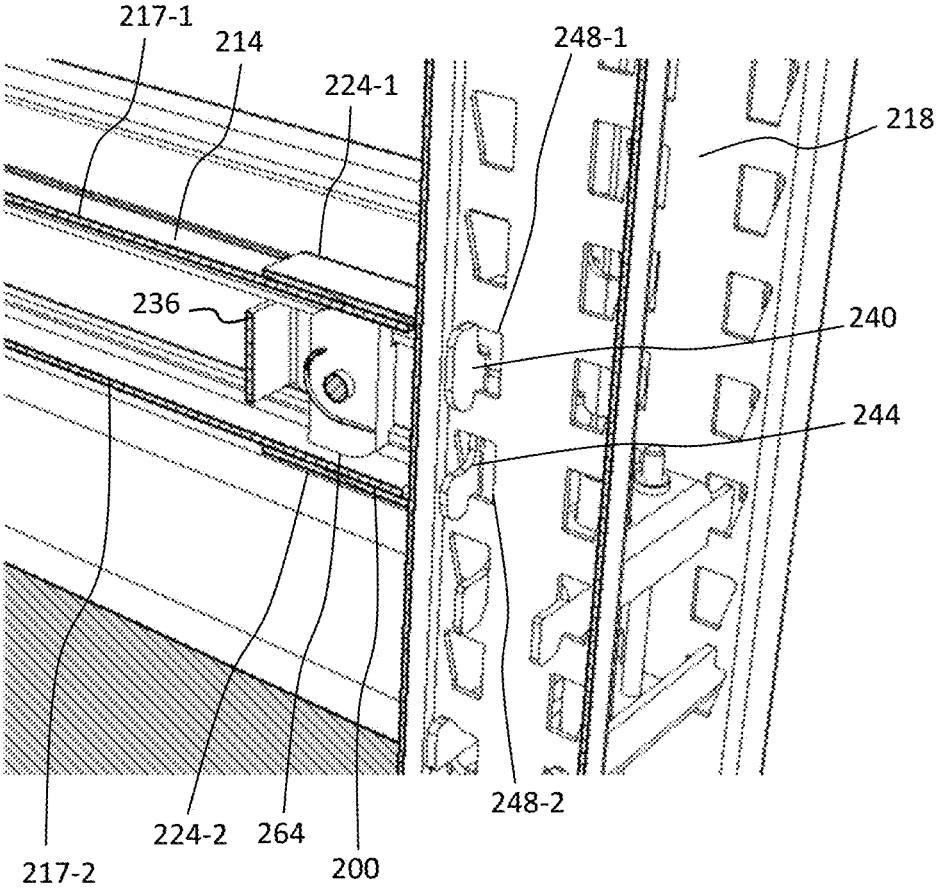
FIG. 20 illustrates a perspective view of a horizontal strut attached to a vertical strut with an end bracket according to an example of the principles described herein.

FIGS. 10-15 illustrate corresponding views of a right end bracket 200 from a back view perspective. With reference to FIG. 20, the right end bracket 200 is used to secure a right end of a horizontal strut 214 to a vertical strut 218 with the body member 206 shown on the outside of the horizontal strut 214. The right 200 and left end brackets 100 are mirror images of each other, as shown.

Both end brackets 100 and 200 include the same or similar attachment structure. For example, the end brackets 100 and 200 each have respective sets of planar plates 124-1, -2 and 224-1, -2 that extend orthogonally from opposed vertical ends of respective body members 106 and 206. Both end brackets 100 and 200 further include respective extension members 136 and 236 and respective insert members that include first 140, 240, and second insert members 144 and 244.

The various views illustrate relative dimensions of the various attachment structure. For example, the planar plates 124-1, -2 and 224-1, -2 extend outward by the greatest length, followed by the extension members 136 and 236, followed by the insert members 140, 240, 144, and 244. The central holes 109 and 209 are central to respective body members 106 and 206 by the vertical and lateral lengths excluding the portions with the notches 127-1, -2 and 227-1, -2 and divets 150 and 250. In other words, an imaginary orthogonal line drawn on the body members 106 and 206 from vertical edges that excludes portions with notches 127-1, -2 and 227-1, -2 and divets 150 and 250 is used to define a starting edge of the area of the body member 106 and 206 in which to find a central hole 109 and 209.

In other examples, the central holes 109 and 209 are measured from outermost vertical and lateral edges of the body members 106 and 206. In further examples, at least one hole is found to be more vertical or more lateral than the central holes 109 and 209 depicted.

Also shown are set holes 126-1, -2 and 226-1, -2 that includes holes on respective planar plates 124-1, -2 and 224-1, -2 and which are used for screws to fasten planar plates 124-1, -2 and 224-1, -2 to side rails 217-1, -2 of a horizontal strut. Screws in set holes 126-1, -2 and 226-1, -2 provide additional support for the screws 158, 258 used in the central holes 109 and 209. (See FIG. 25). Note that set holes 126-2 and 109 are horizontally offset from each other. Such a configuration prevents rotation and dislodgement of the horizontal strut 214 once the horizontal strut 214 is positioned according to a desired location within the end bracket 200.

Figure 16:
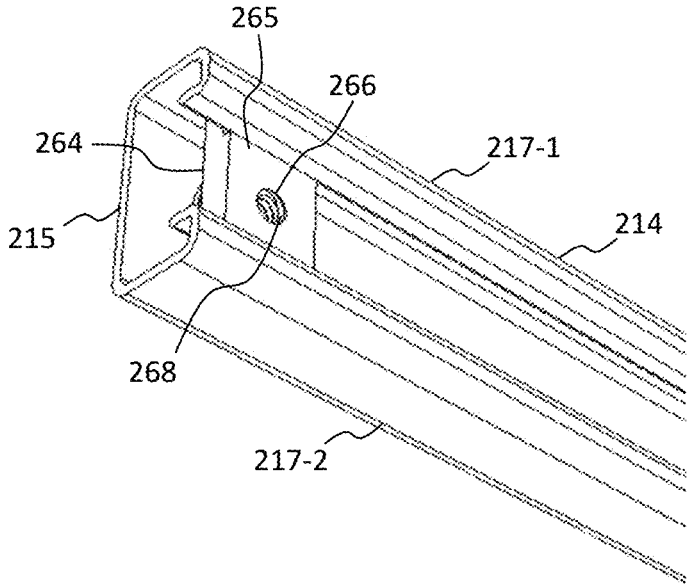
FIG. 16 illustrates a perspective view of a horizontal strut and spring nut according to an example of the principles described herein.

To assemble a horizontal strut with an end bracket, a spring nut is first inserted within the horizontal strut. Turning to FIG. 16, a horizontal strut 214 is shown being configured with spring nut 264. The horizontal strut 214 may include at least one of a rail, slide, channel, slot, or other structure to enable insertion of the spring nut 264 as well as enable linear movement of the end bracket 200 in relation to the horizontal strut 214 and in a horizontal direction. As shown, the horizontal strut 214 includes a main body 215 which is an elongated flat rectangular member having side rails 217-1, -2. Side rails 217-1, -2 that include elongated flat planar members extend orthogonally from vertical edges of the main body 215. Free ends of the flat planar members 217-1, -2 bend vertically downward and then bend again so as to wrap around themselves. The flat planar members 217-1, -2 essentially form a cavity in which one or more components may be slidably inserted.

Figure 19:
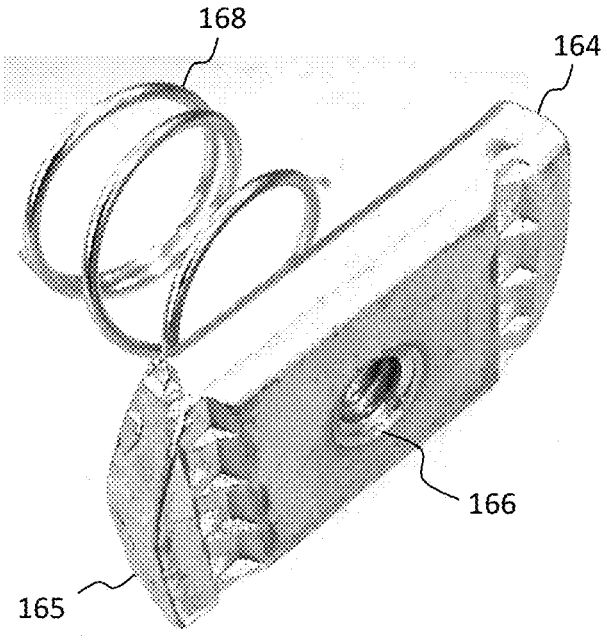
FIG. 19 illustrates a perspective view of a spring nut according to an example of the principles described herein.

As shown, the spring nut 264 is slidably inserted in between the side rails 217-1, -2. FIG. 19 shows a more detailed view of the spring nut 264, which includes a spring 268 attached to a flat body 265 that is a generally flat square or rectangular member. A threaded hole 266 is centrally located on the flat body 265. The flat square sides of the flat body 265 enable the spring nut 264 to slide smoothly along the side rails 217-1, -2 without rotation or other unnecessary movement. Within the side rails 217-1 and 217-2, the spring nut 264 is placed so that the spring 268 is pressed against the main body 215 and the flat body 265 of the spring nut 264 is pressed against free ends of the side rails 217-1, -2.

Figure 17:
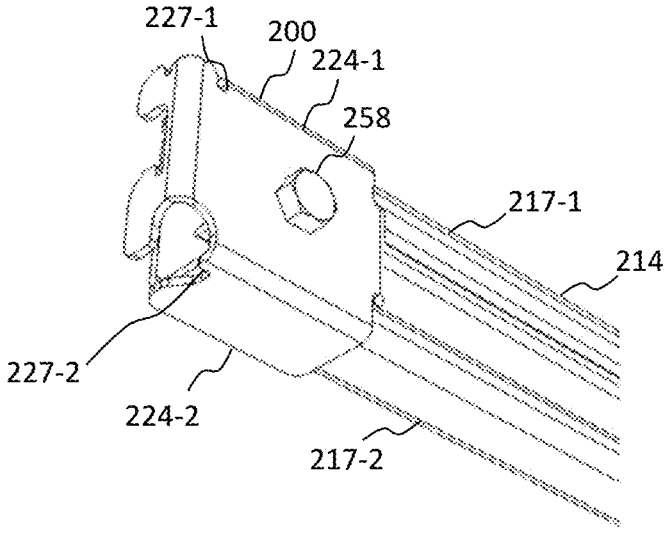
FIG. 17 illustrates a perspective view of a horizontal strut and end bracket according to an example of the principles described herein.

FIG. 17 illustrates the left end bracket 200 attached to the spring nut 264 (FIG. 16) with side rails 217-1 and 217-2 of the horizontal strut 214 being sandwiched. Planar plates 224-1, -2 of the left end bracket 200 extend around outer surfaces of respective side rails 217-1, -2. A screw 258 tightens the end bracket 200 to the spring nut 264 and thereby secures the end bracket 200 to the horizontal strut 214. The spring nut 264 and end bracket 200 slide in tandem longitudinally along the horizontal strut 214 so that the end bracket 200 can be tightened at any location along the length of the horizontal strut 214.

Figure 18A:
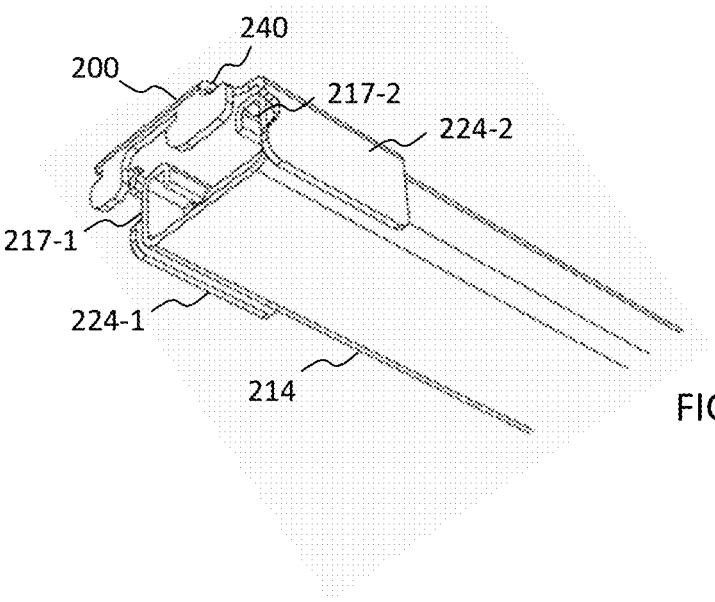
FIG. 18*a* illustrates a perspective view of a horizontal strut and end bracket according to an example of the principles described herein.
Figure 18B:
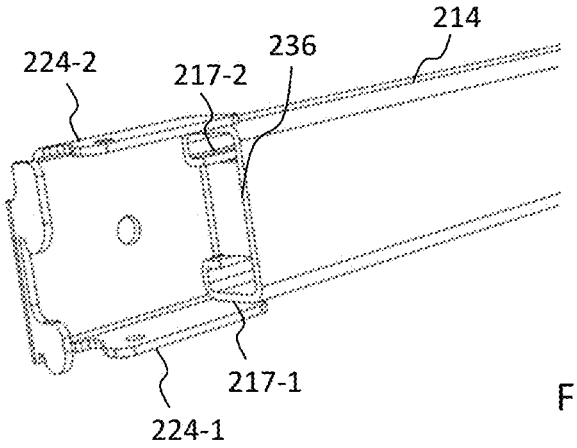
FIG. 18*b* illustrates a perspective view of a horizontal strut and end bracket according to an example of the principles described herein.

FIGS. 18*a* and 18*b* illustrate perspective views of the horizontal strut 214 being inserted within the left end bracket 200. In both views, the insertion is only a partial insertion with edges of the left end bracket 200 sticking out past outer edges of the horizontal strut 214. The horizontal strut 214 is inserted so that side edges of the extension member 136 extend between inside surfaces of side rails 217-1 and 217-2 of the horizontal strut 214. The extension member 136 provides a guide and a stable frame in which the horizontal strut 214 can be slidably joined. On the outside of the horizontal strut 214, planar plates 224-1, -2 surround outside surfaces of rails 217-1, -2 of the horizontal strut 214. The planar plates 224-1, -2 also ensure a guide and a stable frame in which the horizontal strut 214 can be slidably joined.

In each scenario, the notches 227-1, -2 provide a visibility window or space in which the horizontal strut 214 may extend so as to increase the apparent length that the horizontal strut 214 provides. The screw 258 is used to fixate the horizontal strut 214 to the left end bracket 200 to the desired length, such as the length shown in FIG. 18*a*.

FIG. 20 shows a perspective view of the left end bracket 200 secured to the horizontal strut 214 and vertical strut 218.

The extension member 236 can be seen inserted between planar plates 224-1, -2. Note that the lengths shown of the extension member 236 and the planar plates 224-1, -2 do not extend past the lengths of the rails 217-1, -2. The left end bracket 200 thus appears to seamlessly merge with dimensions of the horizontal strut 214. This maintains a relatively even weight distribution along the horizontal strut and avoids extra forces such as bending and torsional forces. Examples may include, however, that lengths are not the same and that at least one of the extension member 236 and planar plates 224-1, -2 extends past the lengths of the rails 217-1, -2.

First insert member 240 extends upward in upper slot 248-1 of vertical strut 218 so as to secure the left end bracket 200 and restrict longitudinal and rotational movement of the left end bracket 200. Second insert member 244 extends downward for resting the left end bracket 200 against edges of a lower slot 248-2 of the vertical strut 218.

Figure 21:
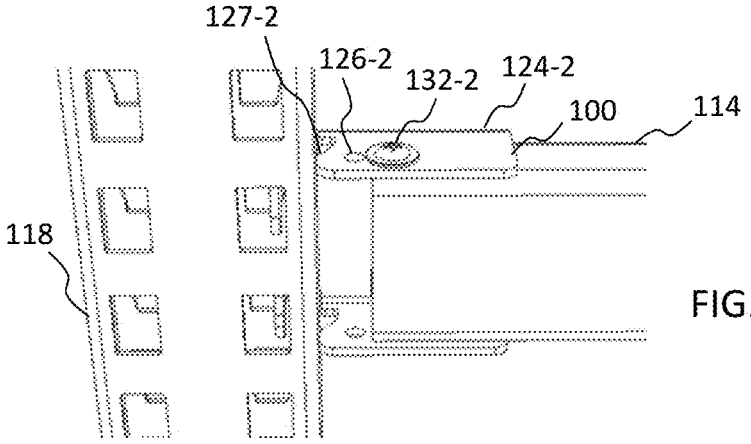
FIG. 21 illustrates a back view of a horizontal strut attached to a vertical strut with an end bracket according to an example of the principles described herein.
Figure 22:
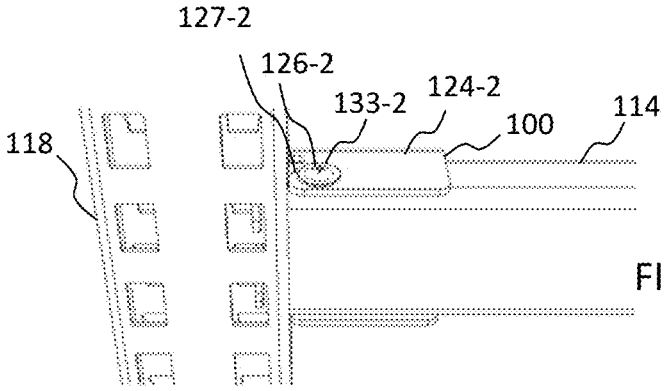
FIG. 22 illustrates a back view of a horizontal strut attached to a vertical strut with an end bracket according to an example of the principles described herein.
Figure 23:
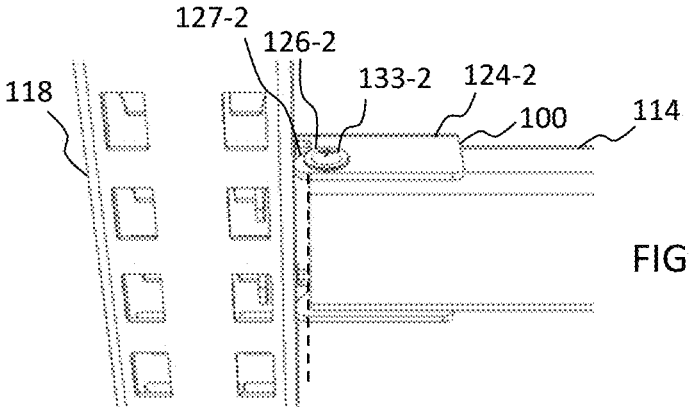
FIG. 23 illustrates a back view of a horizontal strut attached to a vertical strut with an end bracket according to an example of the principles described herein.

FIGS. 21-23 illustrate examples of locations of the horizontal strut 114 made possible by the right end bracket 100. The end bracket 100 includes a length that structurally accommodates longitudinal, horizontal movement of the horizontal strut 114 within the end bracket 100. The length of the end bracket 100 still supports a substantial length of the horizontal strut 114 once the horizontal strut 114 is positioned such that the horizontal strut 114 experiences no sagging or weakness that would lessen the structural integrity of the horizontal strut 114. Movement of the horizontal strut 114 may be restricted to a length that maintains the structural integrity. For example, movement may be restricted to a length that is less than half the length of the end bracket 100. In another example, the position of the screw 132-2, 133-2 may be restricted to a position or a range of positions to maintain the structural integrity.

FIG. 21 depicts a maximum fit in which the horizontal strut 114 is moved longitudinally within the end bracket 100 such that it is spaced away from the vertical strut 118 by a distance that supersedes the distance of the set hole 126-2 from the vertical strut 118. Not using the set hole 126-2, a self-drilling screw 132-2 can still be used to tighten the right end bracket 100 into the horizontal strut 114. A self-drilling screw 132-2 or a regular screw that goes through the set hole 126-2 can penetrate the material of the horizontal strut 114 or provide a mere pressure fit.

FIG. 22 depicts a minimum fit in which the horizontal strut 114 is moved longitudinally within the end bracket 100 until it contacts the outer side of the vertical strut 118. A regular screw 133-2 is used to screw into the set hole 126-2. In this example, the end bracket 100 may still be used to provide support at the intersection of the two struts 114 and 118. Also, for wall systems that are modular or for spaces where future remodeling is anticipated, it is still useful to have an end bracket 100 in place.

FIG. 23 depicts a nominal fit in which the horizontal strut 114 is moved longitudinally within the end bracket 100 until it is lined up with an imaginary line that is orthogonal to vertical main body 115 and that excludes the portion area that of the notch 127-2. This line is indicated by a dashed line. The nominal fit includes a range of positions of the horizontal strut 114 within the end bracket 100 in which the set hole 126-2 can be used. A regular screw 133-2 can be used to screw into the set hole 126-2.

Figure 24:
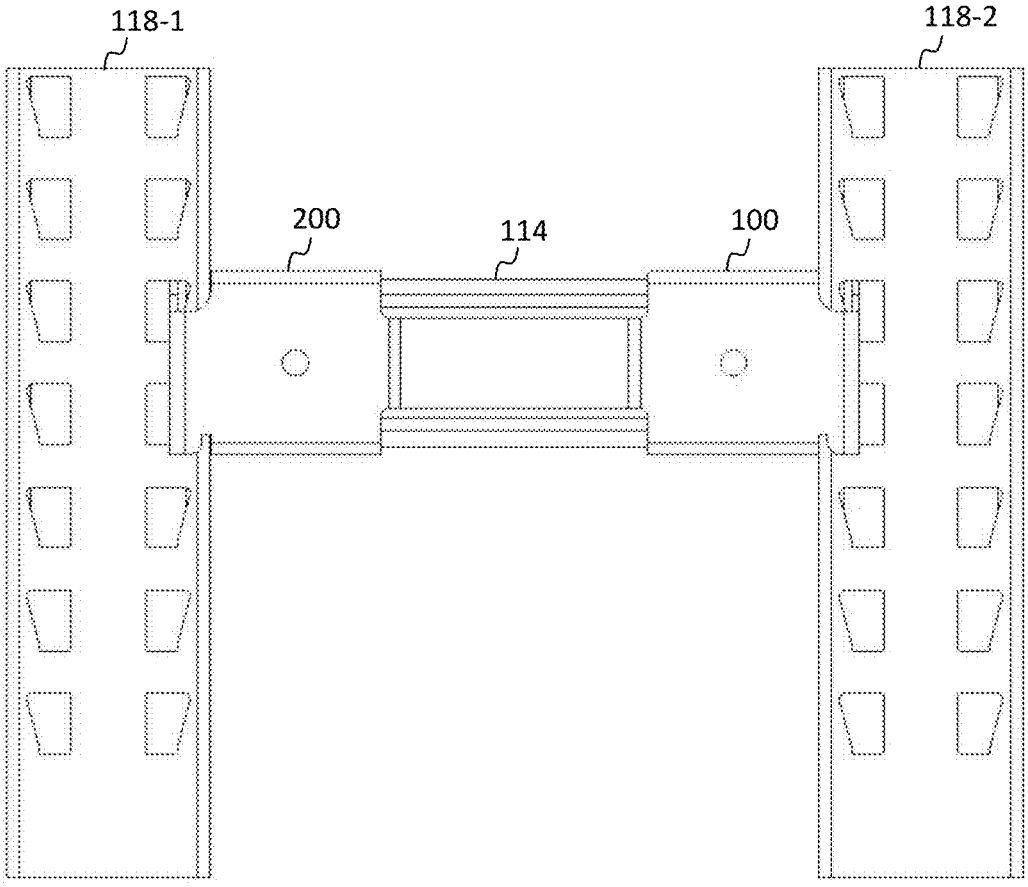
FIG. 24 illustrates a front view of a horizontal strut attached between two vertical strut with end brackets according to an example of the principles described herein.

FIG. 24 illustrates both a left end bracket 200 and a right end bracket 100 used to attach a horizontal strut 114 between vertical struts 118-1 and 118-2. Both left 200 and right end brackets 100 allow for variable distances of the horizontal strut 114 to make slight adjustments in millimeter or centimeter lengths and also create the type of fit desired, whether it be snug or tight.

Figure 25:
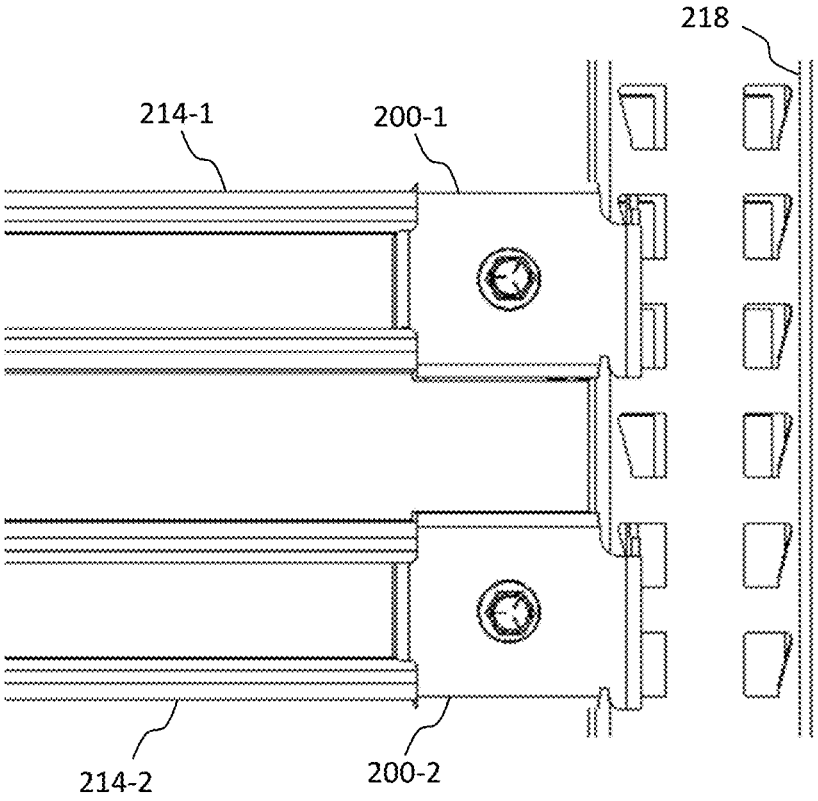
FIG. 25 illustrates a front view of two horizontal struts attached to a vertical strut with an end bracket according to an example of the principles described herein.

FIG. 25 illustrates how end brackets can be positioned along the length of a vertical strut. FIG. 25 also indicates how more than one end bracket can be positioned along the length of a vertical strut. As shown, horizontal strut 214-1 is located at a higher position than horizontal strut 214-2. The lengths of each horizontal strut 214-1, -2 may be adjusted to different lengths to accommodate anomalies in the wall system, struts, and for various other reasons.

Figure 26:
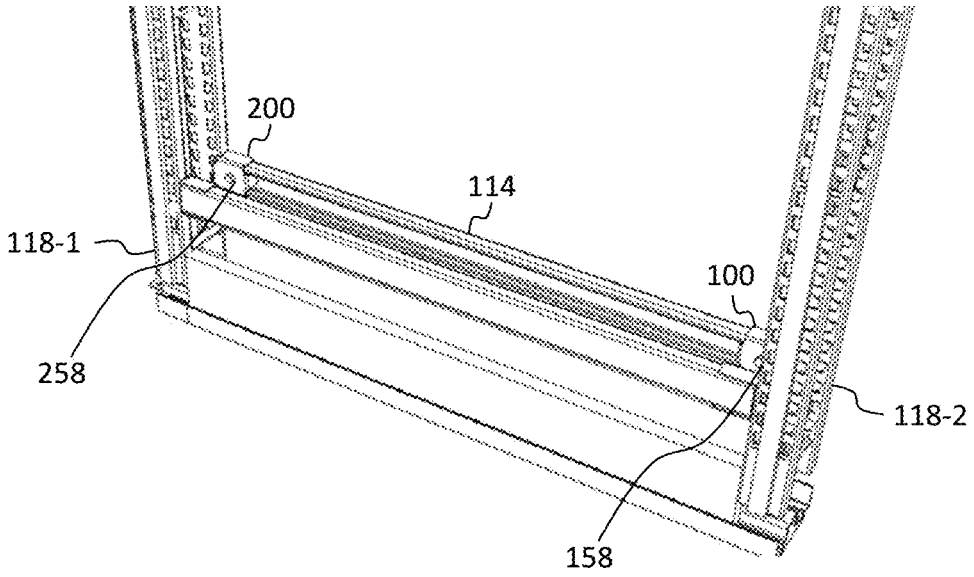
FIG. 26 illustrates a perspective view of a horizontal strut attached between two vertical strut with end brackets according to an example of the principles described herein.

FIG. 26 illustrates both a left end bracket 200 and a right end bracket 100 used to attach a horizontal strut 114 between vertical struts 118-1 and 118-2. Additional structure as shown is used to help create a wall system for a room or other type of space. The horizontal strut 114 may be moved upward and downward to various slots along the vertical struts 118-1, -2 to achieve support at various heights. The end brackets 100 and 200 being screwed together may be easily removed to allow the horizontal strut 114 to be installed and removed without having to remove or rearrange other members of the wall system.

End brackets can not only be used with wall systems, but they may also be used with a modular wall system. For example, they may be used to create walls that can be taken down easily. They may also be used to shorten or widen existing walls.

Installing a wall system with end brackets takes a fraction of the time as present construction methods require and with zero dust and no mess left behind. Components used with the end brackets enable a quick connect type platform that allows creativity, aesthetically pleasing, high-performing, and cost-effective means of achieving a desire space.

The material of the end brackets may be metal, plastic, or a combination thereof. The material may comprise sound absorbing features. Foams, plastic, coatings, cellulosic material, fabric and other materials may also be included.

The end brackets may be a unitary body that is bent at vertical and lateral sides of a body member. Examples further include that a body member have interconnected components. While edges and corners are shown being slightly rounded, the edges may be more sharply defined. At least one of the widths of the body member and attachment structure may be the same as the horizontal strut and vertical strut.

While examples described herein pertain to end brackets being used with horizontal struts, application of end brackets may be used for any structure used for connections within a digitized wall system, modular system, or other type of structure having connecting componentry. The end brackets may be used, for example, not only to shorten or lengthen horizontal struts but also to shorten or lengthen vertical struts. The end brackets may find further usefulness in shortening or lengthening a distance of connection for cabinets, shelving, wall panels, and modular components, for example. Various cabinets, shelving, wall panels, and modular components may attach directly to the end bracket, for example, on the body member or planar plate of the end bracket.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An end bracket for a wall system, comprising:

a body member having a first attachment structure to join a horizontal strut to a vertical strut; and a second attachment structure in which the horizontal strut is slidably attached for moving and positioning the horizontal strut relative to the vertical strut in forming the wall system, at least a portion of the end bracket available to lengthen the horizontal strut depending on the position of the horizontal strut; and a planar surface on a front side of the body member having at least one concave edge along an edge that is to be adjacent to the vertical strut, the at least one concave edge to allow front visibility of the position of the horizontal strut relative to the end bracket, the concave edge at least partially extending into a surface of the second attachment structure for further visibility at a side of the end bracket.

2. The end bracket in claim 1, wherein at least one of the first attachment structure includes at least one insert member to be inserted within a slot of the vertical strut and thereby removably engage the end bracket to the vertical strut and prevent dislodgment of the end bracket from the vertical strut.

3. The end bracket in claim 1, wherein the first attachment structure includes a second insert member having a divet, sides of the divet to extend vertically downward to engage around the slot and thereby retain the end bracket vertically to the vertical strut.

4. The end bracket in claim 1, wherein the first attachment structure includes a first insert member and an opposing second insert member, the first insert member extending vertically upward to be removably inserted within a first slot of the vertical strut and the second insert member extending vertically downward to be removably inserted within a second adjacent slot of the vertical strut.

5. The end bracket in claim 4, wherein the locking structure includes at least two points of securement between the end bracket and the horizontal strut.

6. The end bracket in claim 1, further comprising a locking structure to allow for a variable horizontal displacement of the horizontal strut relative to the end bracket.

7. The end bracket in claim 1, wherein at least two points are located orthogonal relative to each other on the main body.

8. The end bracket in claim 1, wherein the second attachment structure includes at least one extension member that extends orthogonally away from the main body to be inserted within a framework of the horizontal strut to support and guide the horizontal movement of the horizontal strut.

9. The end bracket in claim 1, wherein the second attachment structure includes a pair of planar plates extending orthogonally from opposed vertical ends of the body member; wherein a horizontal strut is to be slidably mounted between the planar plates of the second attachment structure, the horizontal strut to be horizontally moved to a desired position between the planar plates.

10. The end bracket in claim 1, further comprising an undulating contoured edge along an edge of the first attachment structure, the undulating contoured edge to provide a gap for visibility of the underlying horizontal strut, the undulating contoured edge being on a side edge of the first attachment structure that is adjacent to the vertical strut when attached to the vertical strut.

11. The end bracket in claim 1, wherein the first and second attachment structures extend orthogonally away from outer sides of the flat planar surface of the body member, the horizontal strut to be slidably engaged and supported as defined by the second attachment structure.

* * * * *